US006061864A

United States Patent [19]

Ensson

[11] Patent Number: 6,061,864

[45] Date of Patent: May 16, 2000

[54] MOP FRAME ASSEMBLY

[76] Inventor: Lars Johnny Ensson, Fågelvägen 3, S-671 42 Arvika, Sweden

[21] Appl. No.: 09/077,113

[22] PCT Filed: Nov. 22, 1996

[86] PCT No.: PCT/SE96/01521

§ 371 Date: May 22, 1998

§ 102(e) Date: May 22, 1998

[87] PCT Pub. No.: WO97/18744

PCT Pub. Date: May 29, 1997

[30] Foreign Application Priority Data

Nov. 23, 1995 [SE] Sweden ..... 9504177

[51] Int. Cl.[7] ..... A47L 13/24; B25G 3/38

[52] U.S. Cl. ..... 15/147.1; 15/144.2; 15/228; 15/231

[58] Field of Search ..... 15/228, 229.1, 15/229.2, 229.3, 229.4, 229.6, 229.7, 229.8, 231, 144.1, 144.2, 147.1; 403/90, 58, 83

[56] References Cited

U.S. PATENT DOCUMENTS 2,088,650 8/1937 Hartley .
2,724,853 11/1955 Larson .
2,895,757 7/1959 Kasper .
3,778,860 12/1973 Theilen .
3,792,505 2/1974 Saltzstein .
3,996,639 12/1976 Griffin et al. .
4,663,796 5/1987 Helling et al. .
4,852,210 8/1989 Krajicek .
5,461,749 10/1995 Ahlberg et al. .

FOREIGN PATENT DOCUMENTS 0 401 753 A1 12/1990 European Pat. Off. .
24 19 215 10/1975 Germany .

*Primary Examiner*—Terrence R. Till
*Assistant Examiner*—Jennifer McNeil
*Attorney, Agent, or Firm*—Kilpatrick Stockton LLP

[57] ABSTRACT

The invention relates to a mop frame (5) for cleaning equipment, comprising an elongated plate (10) provided on the upper side with a handle fastener (20). The invention is characterized in that at least the underside of the frame is provided with attachment means (50–64) for the detachable fitting of holder bars (70) to the underside of which Velcro® strips (84) are affixed.

9 Claims, 8 Drawing Sheets

MOP FRAME ASSEMBLY

SCOPE OF INVENTION

This invention relates to a device for the cleaning of level surfaces.

PRIOR ART

For cleaning premises and the like, so-called cleaning mops are used for professional purposes. These consist of a mop frame which often has the appearance of a flat, profiled, elongated plate, a flexibly attached handle on the upper side of the frame and a mop in the form of various types of textile cloth, varying according to the area of application, detachably fitted to the underside of the frame. The handles are often articulated so that they can be rotated in directions forming a hemisphere. The underside of the mop frame is often provided with grooves, into which plastic bars, to which Velcro strips are affixed, are inserted. The Velcro strip has the function of keeping the mops fixed in position during use so effectively that they remain attached to the mop frame even when this is lifted and shaken, but can be removed relatively easily when the mop needs to be changed.

The mop frames which are available on the market function satisfactorily for a great many cleaning operations, but have a number of disadvantages. In order to make the Velcro strips replaceable, they are affixed to a bar which is pushed into grooves on the underside of the frame. This means that the Velcro barbs lie essentially in the same plane as the underside of the frame and thus provide a very poor grip, which in turn means that the Velcro strip has to be relatively wide in order to function adequately. Another disadvantage of this design is that the wide Velcro strips and the affixing of these to the bars are relatively expensive, and also that the groove on the underside for holding the bars is a place for the accumulation of dirt and the like.

The flexibility of the link between the frame and the handle is an advantage in most cleaning operations as it permits good movability of the mop when cleaning floors. For the cleaning of walls and ceilings, however, this flexibility is a disadvantage as the frame cannot then be properly controlled.

For the cleaning of large surfaces use is made either of a mop frame of normal width, generally 55 cm, which makes the work time-consuming, or of an extra-wide mop frame. These wide mop frames are however too clumsy to be used for normal surfaces, which means that the cleaner has to have several different mop frames available for different areas.

BRIEF ACCOUNT OF THE INVENTION

The aim of the present invention is to overcome the above problems. According to one aspect of the invention, this is achieved with a mop frame for cleaning equipment comprising an elongated plate, provided with a flexible handle fastener on the upper side, and characterized in that at least the underside of the frame is provided with attachment means for the attachment of holder bars, to the underside of which Velcro strip is affixed. This design results in the presence of replaceable Velcro strips on the frame, affixed to surfaces which are essentially in the same plane as the underside of the frame. In addition, the holder bars form part of the width of the frame.

According to another aspect of this invention, it offers a mop frame for cleaning equipment comprising a plate provided on the upper side with a handle fastener which is situated in the middle of the mop frame and which comprises a first component joined to the plate via a first hinge, the axis of rotation of which is parallel with the longitudinal direction of the plate, and a second component which is joined to the first component via a second hinge, the axis of rotation of which is perpendicular to the first axis of rotation, which is characterized in that the handle fastener is provided with a locking device capable of locking the second hinge so that the handle can only move by means of the first hinge.

According to another aspect of this invention, it offers a surface cleaning device comprising two mop frames, each provided with a handle fastener, which device is characterized in that the connecting element is detachably connectable to the handle fasteners on the two mop frames in such a way that these are arranged alongside each other with their long sides along a common line, and that a handle fastener is flexibly arranged on the connecting element between the two mop frames.

These and other features of the invention are realizable by virtue of the characteristics indicated in the Patent Claims below. Further characteristics and aspects of the invention are apparent from the following description of a preferred embodiment.

BRIEF DESCRIPTION OF THE DRAWINGS

In the following description of a preferred embodiment, reference will be made to the attached drawings, of which

DESCRIPTION OF PREFERRED EMBODIMENT

Figure 1:
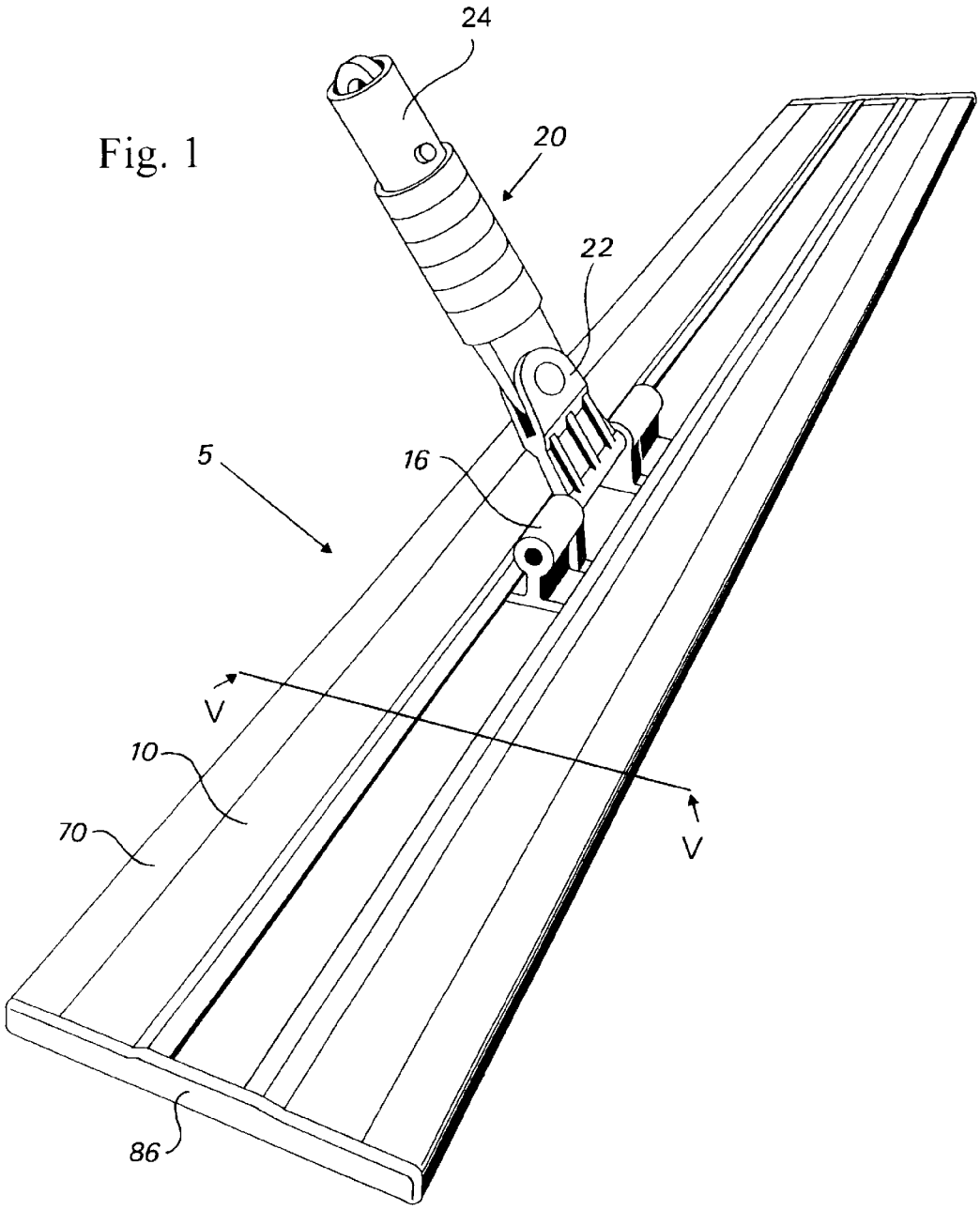
FIG. 1 is a perspective view from above of the mop frame according to the preferred embodiment of the invention.
Figure 2:
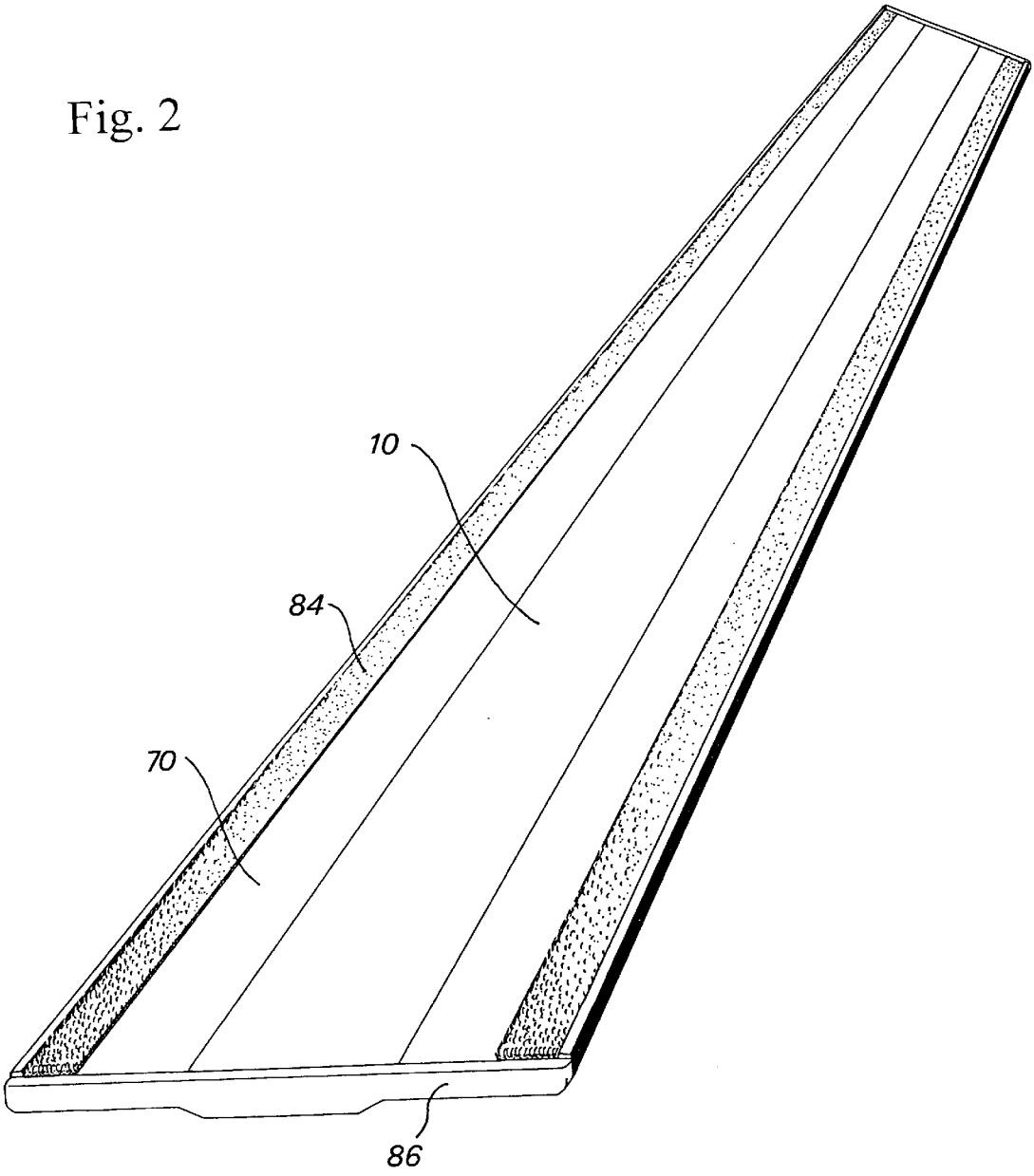
FIG. 2 is a perspective view from below of the mop frame according to FIG. 1.
Figure 5:
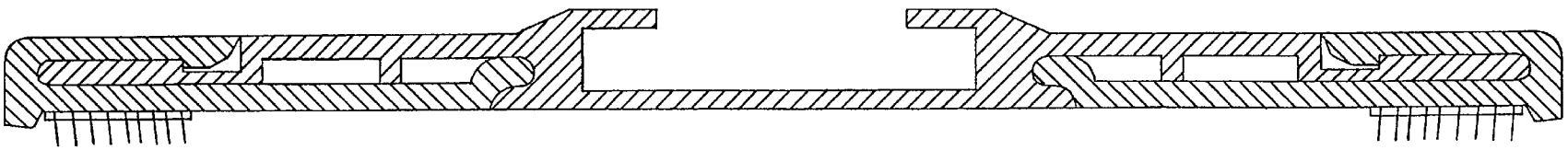
FIG. 5 is a cross-section of the mop frame taken along the line V—V in FIG. 1.
Figure 7:
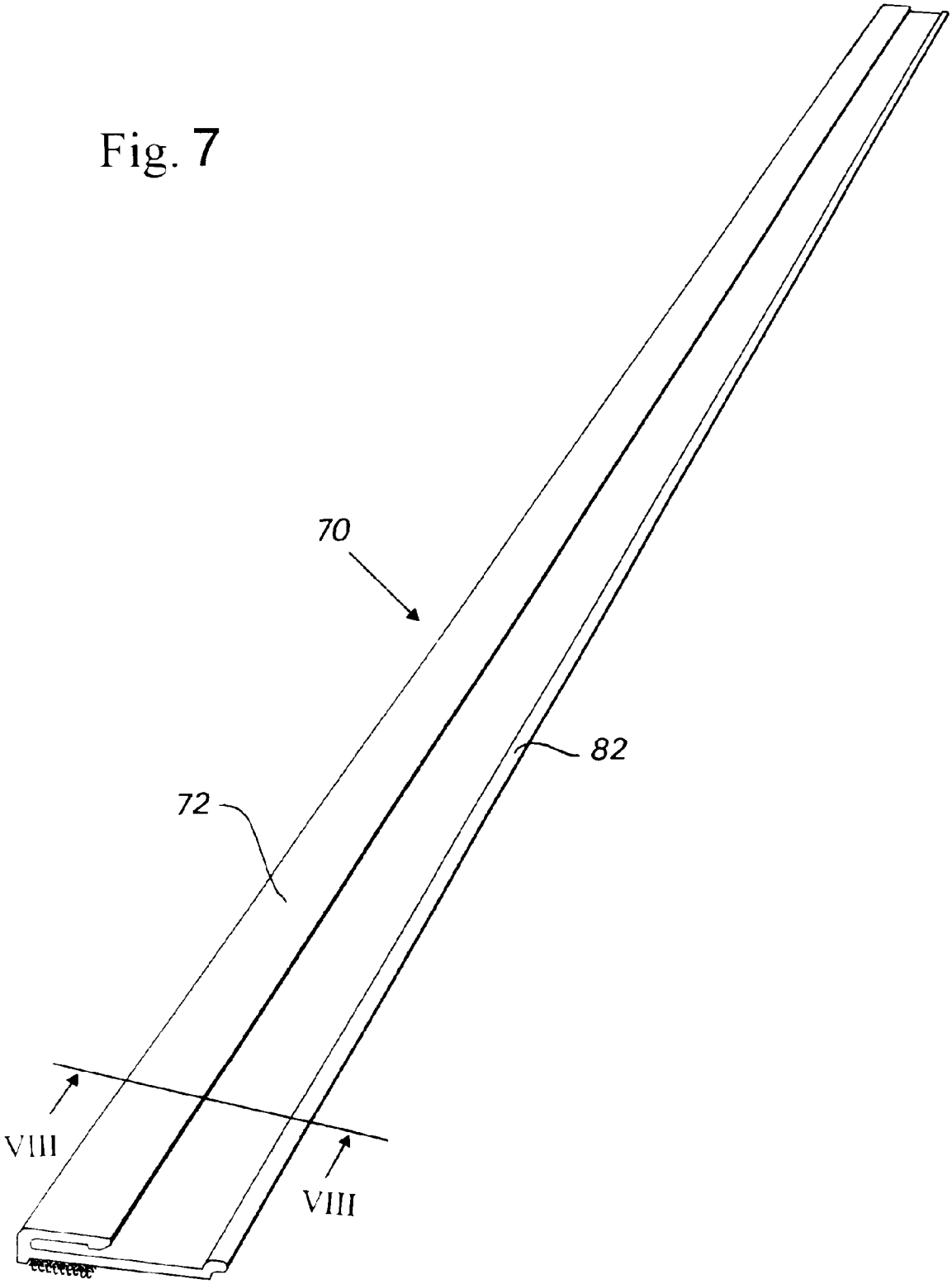
FIG. 7 is a perspective view from above of a holder bar forming part of the mop frame according to FIG. 1.
Figure 9:
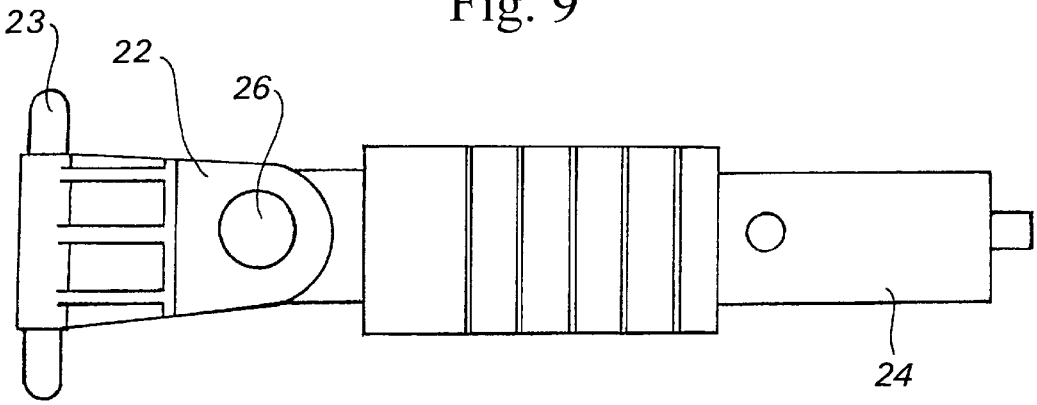
FIG. 9 is a lateral view of a hinge device forming part of the mop frame according to FIG. 1.
Figure 10:
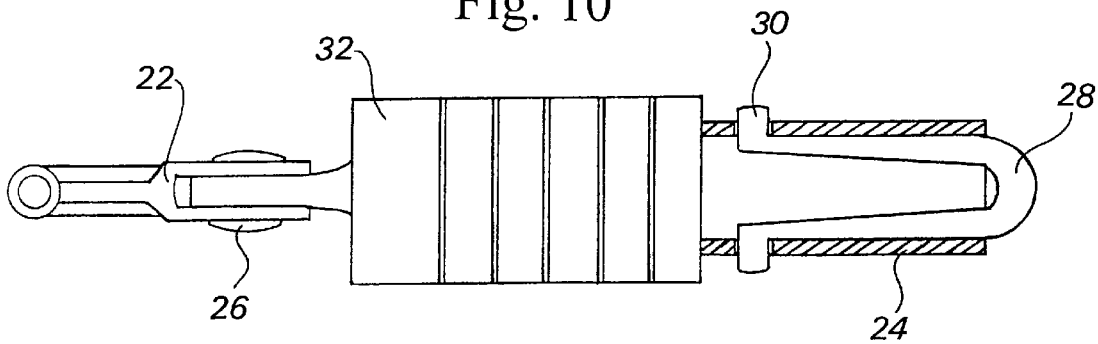
FIG. 10 is a lateral view of the hinge device according to FIG. 9 rotated through 90°.

In the drawings, a mop frame is generally designated by the FIG. 5. The frame 5 comprises an elongated profiled plate 10, made preferably from aluminium or plastic. The upper side of the plate 10 is provided with an elongated groove 12, FIG. 6, which is open at the top and which has two opposing tongues 14, one on each side of the groove. In the groove 12 are fasteners 16 for connection of a handle which is inserted into the groove. The fasteners 16 are held in place at the top by the tongues. In order to restrain the fasteners 16 laterally, the tongues 14 have been pressed down slightly on each side of the fasteners 16, but other means of fixing the fasteners are also possible. Between the fasteners a hinge device 20 is provided, FIGS. 1, 9 and 10.

The hinge device comprises a base component 22 which is provided with two pegs 23 which fit into holes in the fasteners 16, in such a way that the base component 22 is rotatable through approximately 180° in relation to the mop frame 5 in a plane at right angles to the longitudinal direction of the frame.

To the base component 22 is attached, with the aid of a rivet 26 or similar element, one end of an essentially cylindrical intermediate component 24, so that the intermediate component 24 is rotatable through approximately 180° in relation to the base component 22 in a plane parallel with the longitudinal direction of the frame. The opposite end of the intermediate component 24 is provided with connection means 28 for detachable connection of, for example, a handle. The connection means 28 comprises a spring in the form of a U-shaped moulded plastic component, the ends of which are provided with outward-facing lock knobs 30; these lock knobs fit into, and by virtue of elasticity protrude through, two apertures in the intermediate component 24.

The width of the base component 22 increases slightly from the point of attachment to the intermediate component 24 down to the pegs, so that the base component 22 attains a tapered appearance. On the cylindrical part of the intermediate component 24 an essentially cylindrical sleeve 32 is provided, having the facility for sliding along the intermediate component.

With the aid of the hinges a handle can be moved in relation to the mop frame in all directions within a hemisphere.

Figure 3:
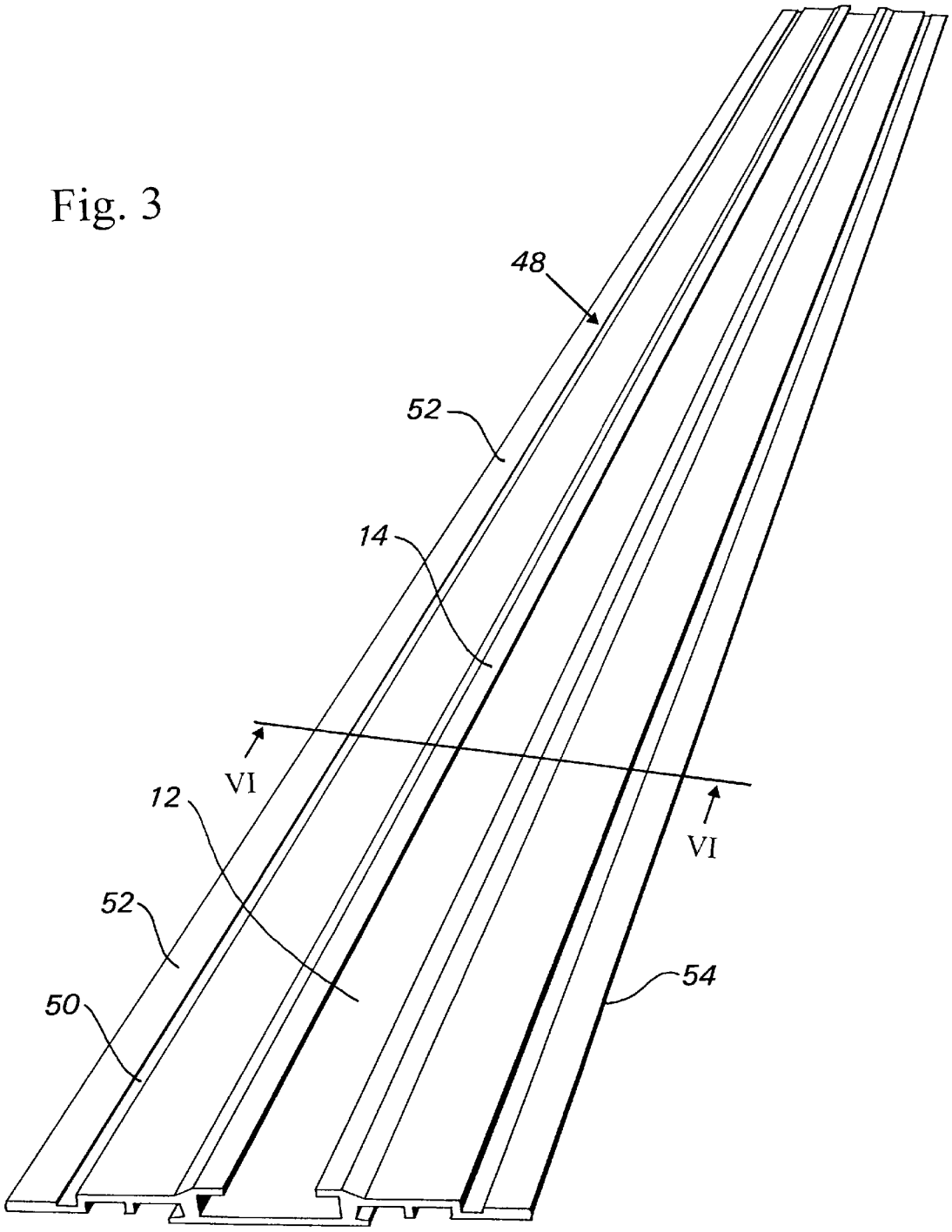
FIG. 3 is a perspective view from above of the plate forming part of the mop frame in FIG. 1.

The plate 10 is so designed on the upper side that it has similar profiling 48 along both long sides. The profiling 48, as viewed from the central groove 12 comprises firstly an essentially rectangular groove 50, FIGS. 3 and 6, which runs parallel with the long side of the plate at a distance x from the edge thereof. After the groove there follows a flat surface 52, extending to the edge 54, which is lower in height than the surface between the central groove 12 and the rectangular groove 50, the height difference being b. The side edges 54 are somewhat rounded.

Figure 4:
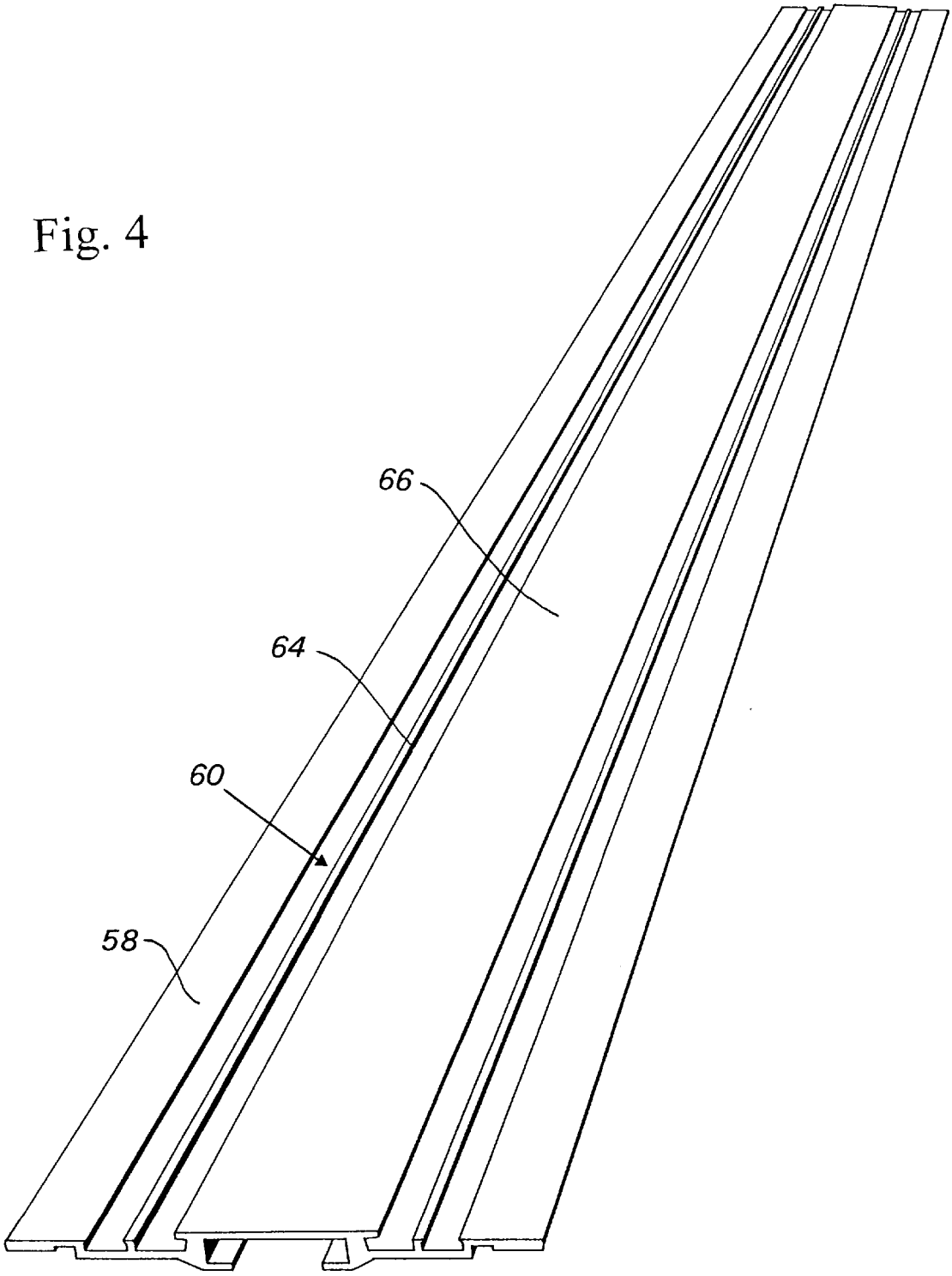
FIG. 4 is a perspective view from below of the frame according to FIG. 2.
Figure 6:
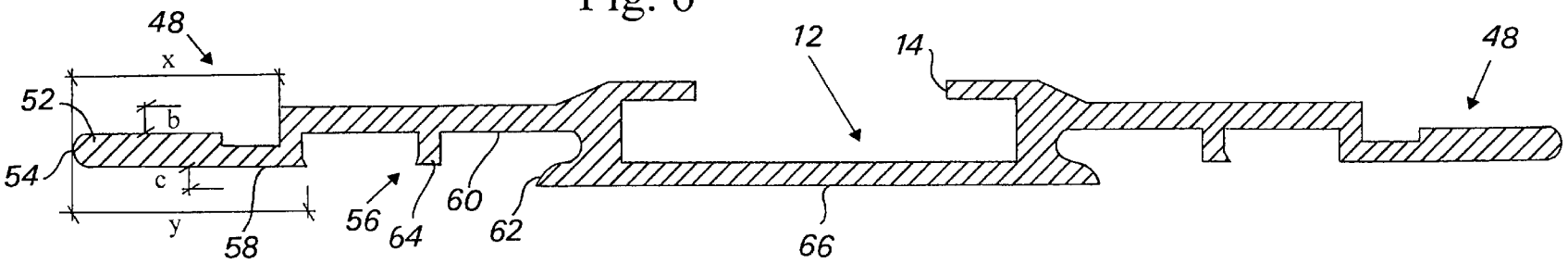
FIG. 6 is a cross-section of the plate taken along the line VI—VI in FIG. 3.
Figure 8:
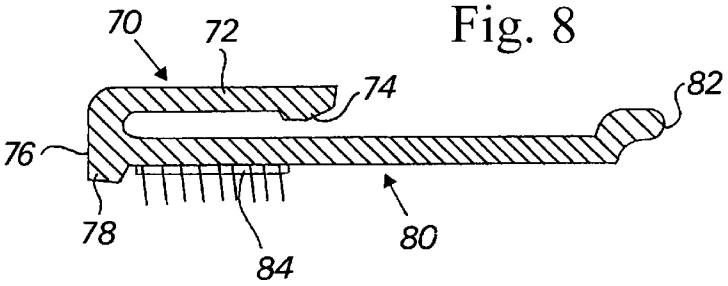
FIG. 8 is a cross-section of a holder bar taken along the line VIII—VIII in FIG. 7.

The underside of the plate 10, FIGS. 4 and 6, is also designed with profiling 56, likewise along both long sides. Viewed from the side edges 54 inwards, the profiling of the underside consists of a flat section 58, which after a distance y, which is longer than the distance x on the upper side of the plate, changes over to an essentially rectangular elongated groove 60. The inner edge of this groove 60 is provided with a tongue or edge 62 directed outwards towards the side edge 54. The groove 60 is furthermore provided with a support strip 64 which from about the middle of the groove 60 extends downwards such a distance that its lower surface lies on a level with the flat section 58. From the grove 60, the remaining central section 66 of the underside of the frame is flat and exhibits a height difference c in relation to the flat section 58.

On the plate 10, FIGS. 4 and 6, holder bars 70 are detachably arranged on both long sides of the plate, FIGS. 1, 5, 6 and 8. These are designed to fit into the profiling 48, 56 on the plate and have a length which is equal to the length of the plate. The holder bar 70 has an upper part 72 the thickness of which corresponds to the distance b on the plate profiling 48. The end face of the bar 70 is provided with a protrusion 74 which extends along the whole length. When the holder bar 70 is fitted to the plate 10, the protrusion 74 fits into the groove 50 on the upper side and prevents the bar from moving. The front edge of the holder bar's upper part then abuts against the inner edge of the groove 50, while the upper surface of the holder bar is essentially on the same level as the upper side of the frame. The upper part 72 of the holder bar then extends some way beyond the edge of the plate where there is a transition essentially to a vertical edge part 76 which at the bottom changes into a support protrusion 78. The holder bar 70 then changes over to a lower part 80 which is essentially parallel with its upper part 70. The lower part terminates in an attachment strip 82 which is designed to fit the indentation in the frame and which, when the holder bar is fitted to the frame, holds the bar in place vertically. With the attachment strip the lower part of the holder bar 70 fits tightly against the frame at the protrusion 62 on the under groove 60.

On the downward-facing surface before the support protrusion 78 a Velcro strip/fastener 84 is affixed with a suitable adhesive, in the preferred embodiment along the whole length of the bar. The Velcro strip 84 may also be designed to finish just before the end of the bar, in order that certain mop cloths can be slipped onto the end of the mop frame, as this cannot be done if the Velcro strip 84 comes right to the edge. The height of the protrusion 78 is lower than the height of the Velcro strip 84, so that the Velcro barbs extend some distance below the protrusions.

At the short ends of the plate 10 are fitted the end pieces 86, preferably made from a relatively soft material so as not to damage objects during cleaning. The end pieces 86 are designed so that lock protrusions (not shown) fit in to the plate profiling and thus hold the end pieces in place.

The holder bars 70 have the following function and advantages. The various mop cloths which are normally used in cleaning have an upper side to which the Velcro strip is attached. The mop cloth is pressed tight against the underside of the frame and stays in place during cleaning. Owing to the fact that the Velcro strips according to the invention are directly affixed to the holder bars 70, they extend downwards below the underside of the frame and a better grip on the mop is obtained than with previous devices. In this way a considerably narrower Velcro strip may be used, and on the tested frames this strip had a width of 8 mm instead of the 20 mm which is normally used. The mop cloths then remain in place during cleaning but are not attached so tightly that they are difficult to remove, which would be the case with a wider Velcro strip. As a narrower strip can be used, the manufacturing cost can also be reduced since the strips and their attachment to the holder bars in the conventional method are relatively expensive. Due to the holder bar, however, the Velcro strip is still replaceable in that the complete holder bar is detachable and exchangeable.

Furthermore, because the holder bar fits tightly against the frame both on the upper side and on the underside, the upper and lower sides of the frame are completely smooth, which means that dirt is prevented from accumulating in pockets and the like on the frame, as was common previously. The holder bars further from part of the width of the frame, which enables the plate to be made narrower for the same total width, which means that less material needs to be used in the plate. This reduces the material costs which may be relatively high when aluminium is used for the plate. Owing to the fact that the holder bars extend around the side edges of the frame, they also act as protective strips and prevent marks and wear and tear on objects, skirting boards and the like which are often bumped with the mop frame during cleaning.

For the cleaning of floors and similar it is an advantage if the handle is articulated in all directions in relation to the frame, in order in this way to achieve greater freedom of movement with the device. However, this movability may in some cases prove a disadvantage, for example when cleaning walls and ceilings. This movability then gives rise instead to a lack of control and to difficulty in getting the frame and the cloth to stay against the wall or ceiling.

In order to prevent movability in one direction with the device according to the invention, a sleeve 32, which is axially movable on intermediate component 24, is pushed upwards over the base component 22; and since the latter is slightly tapered and the sleeve 32 has a certain elasticity, the sleeve 32 is held in place there and thus locks the relative position of the base component and the intermediate component. The handle is then movable only in directions at right angles to the longitudinal direction of the frame and thus it becomes simpler to handle for the surfaces described above. When the sleeve 32 is not in use, it is in contact with the base component 22, but owing to the tapering of the latter it cannot slide down and unintentionally lock the intermediate component against the base component.

Figure 11:
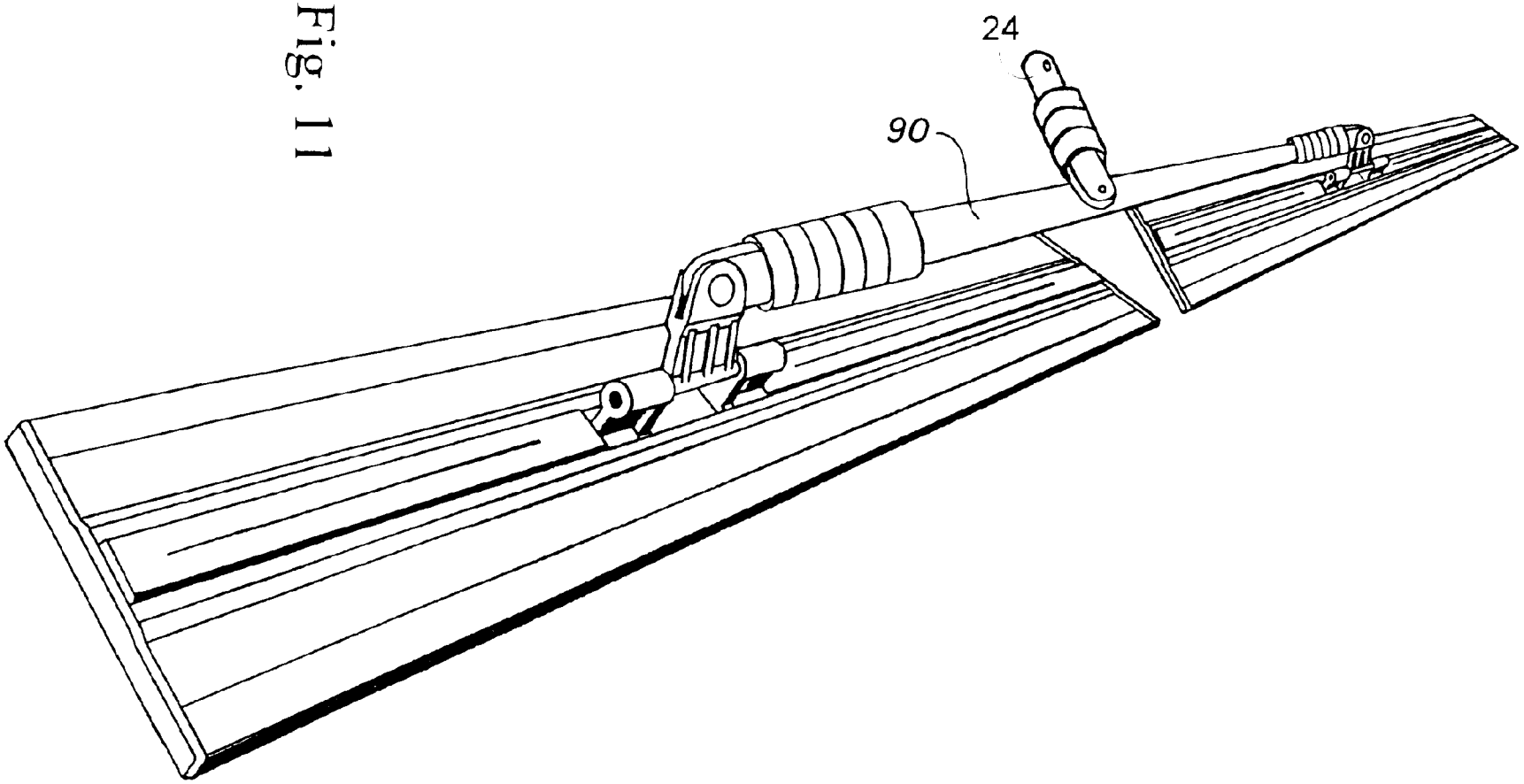
FIG. 11 is a perspective view of the interconnection of two mop frames.

The mop frame according to the invention may be used in conjunction with many different handles, handles of a fixed length or telescopic handles. In order to permit the exchange of handles or frames, the handle is provided with diametrically opposite apertures. The handle is attached to the outer end of the intermediate component, the lock knobs 30 on the lock spring or connection means 28 are pressed in so that the handle can be pushed in against the stop and turned until the lock knobs are positioned in front of the apertures in the handle, so that these then spring out and lock the handle in position. For the cleaning of large surfaces without obstacles, a system has been developed where two frames 10 may be linked together alongside each other so that the width is doubled. This is achieved with the aid of a connecting element 90, FIG. 11, which comprises a tube with a length approximately corresponding to the length of the frames which are to be used. At the ends of the tube are diametrically opposite apertures which have been drilled so that the intermediate components 24 of the hinge devices 20 on the two mop frames may be attached there. When two mop frames are attached to the connecting element, the link between the base component and the intermediate component is turned through 90° and the frames are fixed in a position in which their front edges are in line with each other.

In the middle of the tube 90 is an intermediate component 24 which is rotatably attached, to which a handle may be fastened. Thus one now has two frames alongside each other, that is to say a mop device of double the width is obtained. With this assembly the mop device may be adjusted to differing requirements simply by removing or attaching the components as necessary. Consequently, there is no longer any need to carry several different mop devices with one, the same handle and frame being usable with just a few accessories.

It will be seen that the invention is not restricted to the embodiment described above and illustrated in the drawings, but may be modified within the framework of the following Patent Claims.

I claim:

1. A mop frame for cleaning equipment, comprising an elongated plate provided on an upper side with a handle fastener, characterized in that at least on underside of the plate is provided with attachment means for attachment of holder bars, the holder bars having an underside to which hook-and-loop strips are affixed;

wherein the holder bars are designed and affixed to the plate in such a way that they extend beyond the side edges of the plate, thus forming part of the width of the mop frame; and wherein the upper side of the plate is provided with attachment means for attachment of the holder bars.

2. A mop frame according to claim 1, characterized in that said attachment means on the upper and lower sides are designed as elongated grooves and that the holder bar is designed to extend around an edge of the plate and with its side edges engaged with said grooves.

3. A mop frame according to claim 2, characterized in that the upper parts of the holder bars lie essentially in the same plane as the upper side of the plate.

4. A mop frame according to claim 1, characterized in that the holder bars extend along the entire long sides of the plate.

5. A mop frame according to claim 1, characterized in that the underside of the mop frame which does not carry the hook-and-loop strip is essentially level.

6. A mop frame according to claim 5, characterized in that the surfaces on which the hook-and-loop strip is attached lie essentially in the same plane as the underside of the plate.

7. A mop frame for cleaning equipment, comprising a plate provided on the upper side with a handle fastener, arranged in the middle of the mop frame, which handle fastener comprises a first component joined to the plate via a first hinge, the axis of rotation of which is parallel with the longitudinal direction of the plate, and a second component, which is joined to the first component via a second hinge, the axis of rotation of which is perpendicular to the first axis of rotation, characterized in that the handle fastener is provided with a locking device capable of locking the second hinge so that the handle is only able to move around the first hinge;

wherein the second hinge is locked with the aid of a sleeve which is pushed over the hinge, locking the relative position of the first component and the second component; and wherein the width of the first component tapers outwards from the point of attachment to the second component and that the sleeve is essentially cylindrical and made form an elastic material, so that the sleeve is held in place when it is pushed over the second hinge.

8. A device for the cleaning of level surfaces, comprising two mop frames, each with a handle fastener arranged essentially in the middle of the mop frame, characterized by a connection means which is detachably connected to the handle fasteners on the two mop frames in such a way that these are arranged alongside each other with their long sides along a common line, and in that a single handle fastener is flexibly arranged on the connecting element between the two mop frames;

wherein at least one mop frame comprises an elongated plate provided on an upper side with the handle fastener, characterized in that at least an underside of the plate is provided with attachment means for attachment of holder bars, the holder bars having an underside to which hook-and-loop strips are affixed;

wherein the holder bars are designed and affixed to the plate in such a way that they extend beyond the side edges of the plate, thus forming part of the width of the mop frame; and wherein the upper side of the plate is provided with attachment means for attachment of the older bars.

9. A device according to claim 8, characterized in that the connecting means comprises a tube, the ends of which are designed to fit the handle fasteners of the mop frames, and that the length of the tube is so adjusted that when the device is fitted with two mop frames, only a small distance exists between the opposing ends of the mop frames.

* * * * *